US006199528B1

(12) United States Patent
Hotta et al.

(10) Patent No.: US 6,199,528 B1
(45) Date of Patent: Mar. 13, 2001

(54) COOLING DEVICE FOR INTERNAL COMBUSTION ENGINES

(75) Inventors: Takayuki Hotta; Yasuo Ozawa, both of Aichi-ken (JP)

(73) Assignee: Aisin Seiki Kabushiki Kaisha, Kariya (JP)

( * ) Notice: Subject to any disclaimer, the term of this patent is extended or adjusted under 35 U.S.C. 154(b) by 0 days.

(21) Appl. No.: 09/361,985

(22) Filed: Jul. 28, 1999

(30) Foreign Application Priority Data

Jul. 28, 1998 (JP) ..... 10-213111

(51) Int. Cl.[7] ..... F01P 11/20
(52) U.S. Cl. ..... 123/142.5 E
(58) Field of Search ..... 310/85, 86, 87, 310/62, 63; 123/142.5 E, 179.21, 41.44; 417/32, 366, 369

(56) References Cited

U.S. PATENT DOCUMENTS 4,516,915 * 5/1985 Jensen et al. ..... 310/87
4,728,268 * 3/1988 Laing ..... 417/420
5,079,488 * 1/1992 Harms et al. ..... 123/41.44
5,435,277 7/1995 Takahashi .
5,616,973 * 4/1997 Khazanov et al. ..... 310/54
5,785,013 * 7/1998 Sinn et al. ..... 123/41.44
5,909,072 * 6/1999 Muller ..... 318/254

* cited by examiner

*Primary Examiner*—Willis R. Wolfe
*Assistant Examiner*—Hyder Ali
(74) *Attorney, Agent, or Firm*—Burns, Doane, Swecker & Mathis, LLP

(57) ABSTRACT

A cooling device for an internal combustion engine includes a brushless DC motor having a housing, an output shaft, a magnet rotor fixedly mounted on the output shaft, and a stator positioned in the housing and having three phase windings which are arranged in the circumferential direction around the magnet rotor, an impeller connected at an outside of the housing to one end of the output shaft of the motor and circulating a cooling liquid through the engine, and a radiator while the output shaft is being rotated. A device can be provided for generating heat at the phase windings for warming-up the cooling liquid if a temperature thereof is below a set value. A device can be provided for stopping the rotation of the output shaft of the motor without interrupting the energization of the motor when a temperature of the cooling liquid is below a set value.

16 Claims, 5 Drawing Sheets

FIG. 2
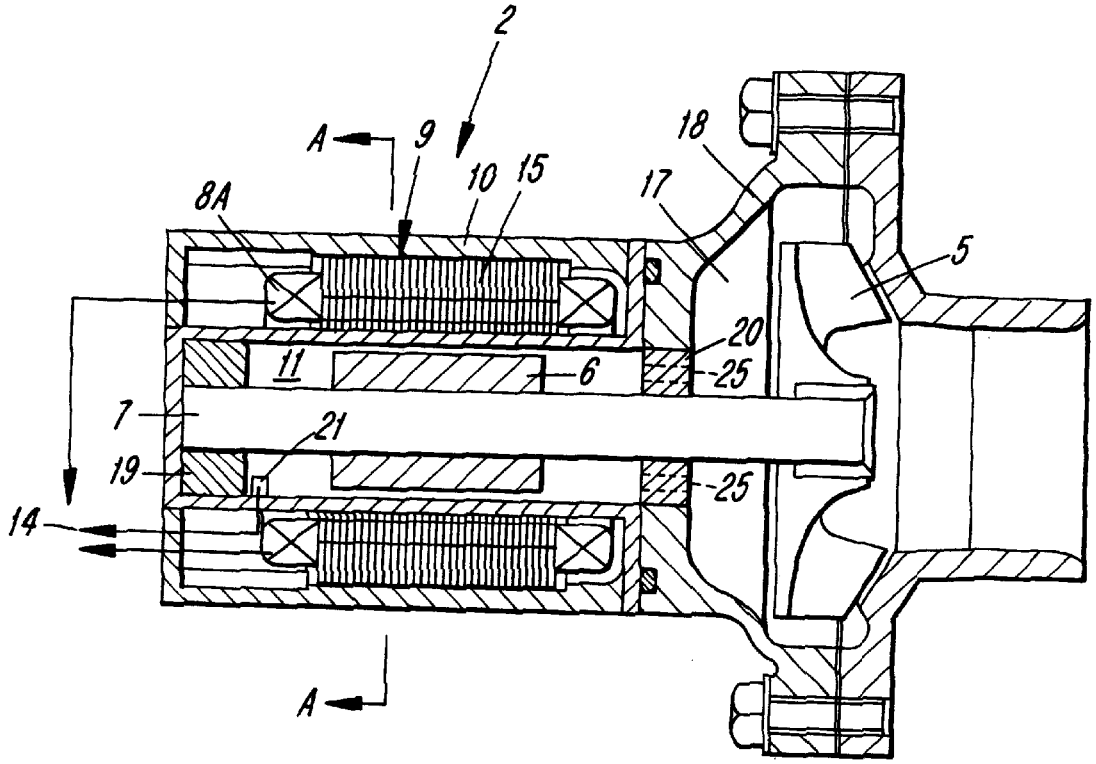
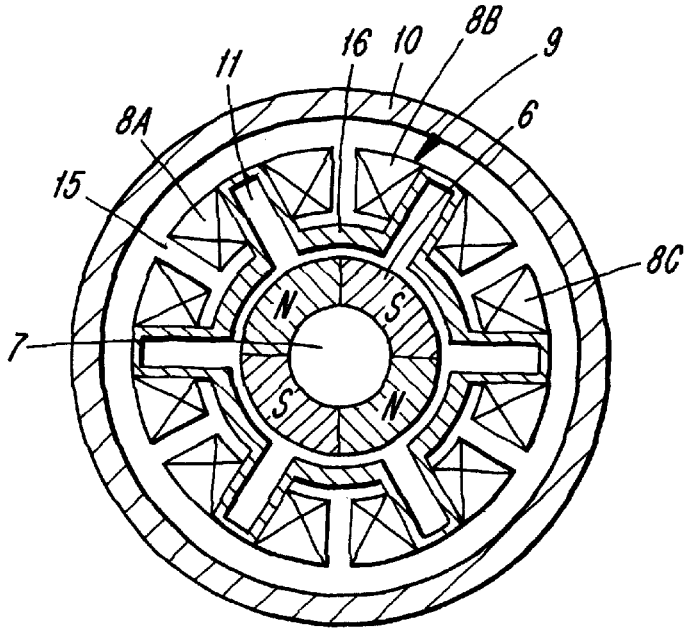
FIG. 3

COOLING DEVICE FOR INTERNAL COMBUSTION ENGINES

BACKGROUND OF THE INVENTION

1. Field of the Invention

The present invention relates to a cooling device for internal combustion engines wherein cooling water is circulated through a radiator and the internal combustion engine. More particularly, the present invention relates to a cooling device of the type in which a shorter time period of engine warm-up mode can be established.

2. Prior Art

A need has existed to shorten the time period for an engine to warm up. U.S. Pat. No. 5,435,277 proposes a device to address this concern, wherein an amount of high temperature water is injected into an engine whenever the engine is started, thereby accelerating the warming-up operation of the engine. Thus, the time period for an engine warm-up mode can be shortened.

However, for establishing such an injection of high temperature water, a tank for storing the water has to be prepared. In addition, an additional water passage has to be connected to the existing water circulation line, and the resultant complexity thereof in structure makes it cumbersome to assemble.

SUMMARY OF THE INVENTION

In light of the foregoing, a cooling device for internal combustion engines is desired which is free from the foregoing drawbacks.

In order to attain the foregoing objects, a first embodiment of the present invention provides a cooling device for an internal combustion engine which includes:

an electrically operated motor having a housing, an output shaft, a magnet rotor fixedly mounted on the output shaft, and a stator positioned in the housing;

an impeller connected at an outside of the housing to one end of the output shaft of the motor and circulating a cooling liquid through the engine and a radiator while the output shaft is being rotated; and means for generating a heat at the phase windings for warming-up the cooling liquid if a temperature thereof is below a set value.

A second embodiment of the present invention provides a cooling device for an internal combustion engine which includes:

an electrically operated motor having an output shaft and rotating the output shaft upon energization of the motor;

an impeller connected to one end of the output shaft for circulating a cooling liquid through the engine and a radiator while the output shaft of the motor is being rotated; and means for stopping the rotation of the output shaft of the motor without interrupting the energization of the motor when a temperature of the cooling liquid is below a set value.

A third embodiment of the present invention provides a cooling device for an internal combustion engine comprising:

a brushless DC motor having an output shaft, a magnetic rotor fixedly mounted on the output shaft, and a stator having three phase windings which are circumferentially arranged around the output shaft;

an impeller connected to one end of the output shaft for circulating a cooling liquid through the engine and a radiator while the output shaft of the motor is being rotated; and means for energizing the stator so that current supplied to each of the phase windings is supplied based on an angular position of the output shaft.

BRIEF DESCRIPTION OF THE DRAWINGS

The above and other objects, features and advantages of the present invention will be more apparent and more readily appreciated from the following detailed description of preferred exemplary embodiments of the present invention, taken in connection with the accompanying drawings, in which;

FIG. 2 is a cross-sectional view of the liquid pump shown in FIG. 1;

FIG. 3 is a cross-sectional view taken along line A—A in FIG. 2;

DETAILED DESCRIPTION OF THE PRESENT INVENTION

Preferred embodiments of the present invention will be described hereinafter in detail with reference to the accompanying drawings.

Figure 1:
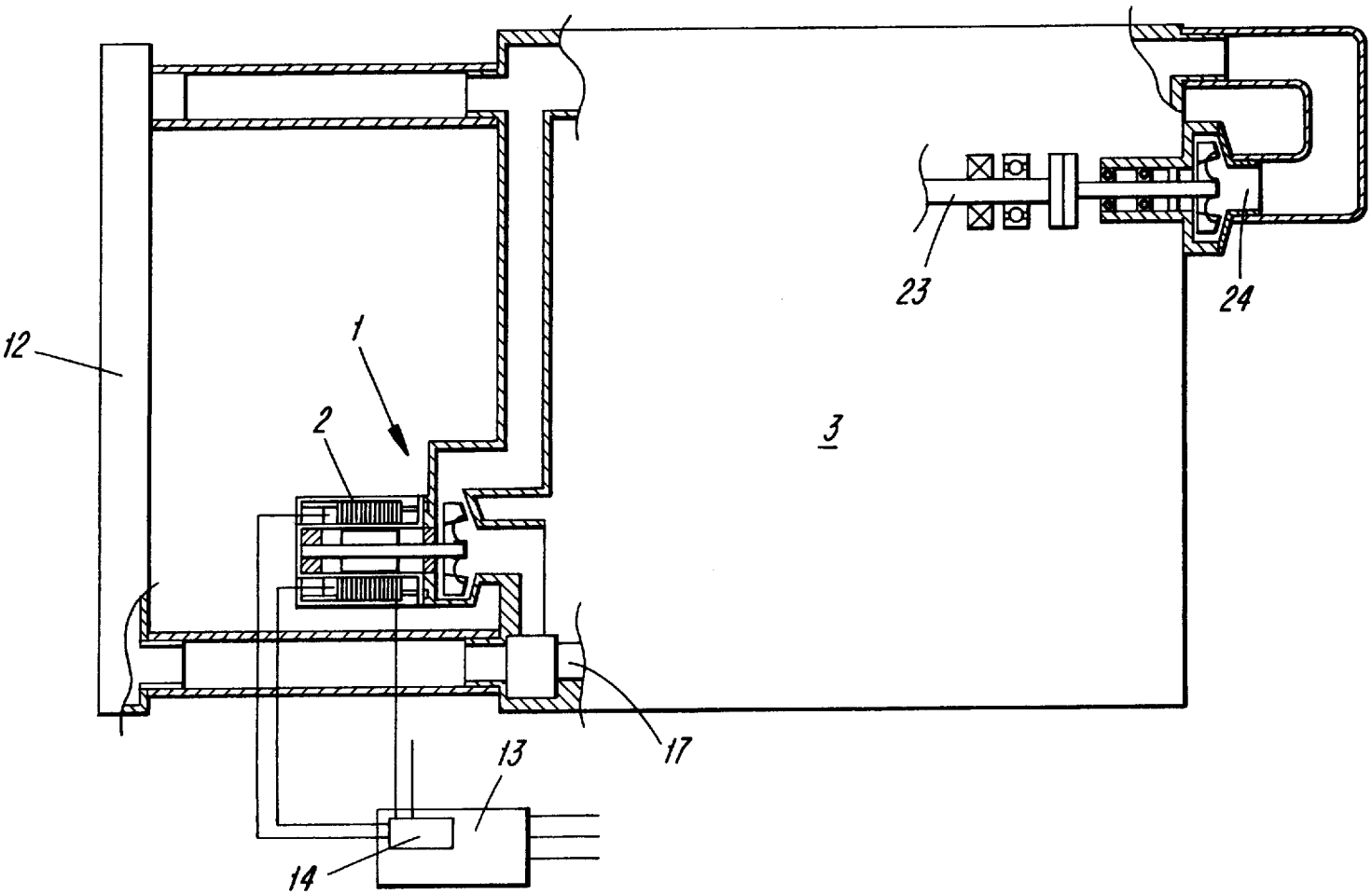
FIG. 1 is a schematic illustration of a first embodiment of a cooling device in accordance with the present invention.

Referring first to FIG. 1, there is illustrated a cooling device which has, as a major element, a liquid or water pump 1 fixedly mounted to an internal combustion engine 3. The engine 3 is supplied with cooling water from a radiator 12 and the resultant cooling water passes through a passage 17 in the engine 3. The cooling water which is warmed up to a hot temperature during movement through the engine 3, due to hear transfer from the engine 3 at a high temperature to the cooling water at a lower temperature, is returned to the radiator 12. While the cooling water passes through the radiator 12, heat transfer is established from the cooling water to ambient air by close contact therebetween in the radiator 12, whereby the cooling water is re-cooled and the cooling water is used again to cool the engine 3. Thus, circulating the cooling water through the radiator 12 and the engine 3 allows continual cooling of the engine 3.

Referring next to FIG. 2, there is illustrated the detailed structure of water pump 1 which is used to circulate the cooling water through the radiator 12 and the engine 3. For driving or running the water pump 1, an electric motor 2 is used for converting an electrical input from a battery (not illustrated) into a mechanical output. A control division 14 is provided to the motor 8 for activating and deactivating each phase winding or coil 8 of the motor 2. The control division 14 is a portion of a control device 13 which processes various input and output signals regarding vehicle cruise control.

The electric motor 2, which is in the form of a brushless DC motor, includes an output shaft 7 including a rotor fixedly mounted thereon, and is also provided at a distal end thereof with a metallic impeller 5 for circulating the cooling water, a core 15 positioned outside the rotor 6 such that a space is defined therebetween, a stator 9 constituted by the core 15 and a plurality of equi-pitched angularly spaced coils 8 which are arranged inside the core 15, and a housing 10 accommodating the stator 9 therein and fixed to the engine 3.

At an inside portion of the stator 9, a partition wall 16 is fixed which has the shape illustrated in FIG. 3, thereby defining a chamber 11 between the partition wall 16 and the output shaft 7, into which the cooling water flows. It is to be noted that the partition wall 11 acts as a seal member so as to prevent a flow of the cooling water toward the stator 9 from the chamber 16.

The distal end of the shaft 7, which includes the impeller 5 mounted thereon, extends into a midway portion 17 of a passage formed in housing 18. The midway portion 17 is positioned in the passage through which the cooling water passes. A base end of the shaft 7 is supported on flat bearing 19 fitted in the partition wall 16, which is secured to the housing 18. The shaft 7 is also supported on a flat bearing 20 fitted in the housing 18 so that the flat bearing 20 is located between the chamber 11 and the midway portion 17 in the passage. The flat bearing 20 is provided with a plurality of axially extending passages 25 for continual fluid communication between the chamber 11 and the midway portion 17 of the passage.

In the chamber 11, a temperature sensor 21 is installed for determining a temperature of the cooling water. The cooling water temperature determined at the temperature sensor 21 is fed, as an electric signal, to the control division 14 and is used for controlling the coils 8.

The rotor 6 which is in the form of a circular magnet is pressed onto the shaft 7 and is fixed thereto by bonding. An outer surface of the circular magnet 6 has two pairs of N poles and S poles alternatingly formed by magnetizing as shown in FIG. 3. Alternatively, separate magnets already or previously magnetized may be used as circular magnet 6, and the number of poles is not limited to that illustrated in FIG. 3.

The stator 9 is formed by providing three-phase coil portions 8 which are positioned diagonally inside the core 15. Each coil portion 8 is made by winding a copper wire which has excellent conductivity. The stator 9 is fitted in the housing 10.

When three-phase coil portions 8 are electrically turned on or energized (altematingly) by the battery, the coil portions 8 generate electromagnetic forces, whereby the water pump 1 is driven. That is to say, a magnetic field is formed between the core 15 and the magnet 6. Turning on the coil portions 8 controls the changing of N poles and S poles generated in the core 15, and the shaft 7 rotates by attracting the magnetic flux from the magnet 6 to the coil portion 8.

To stop rotation of the shaft 7 of the motor 2, all of the three-phased coil portions 8 are activated by the control division 14, instead of in-turn or sequential activation of one-phased coil portions 8 as described above. Under such a state or the concurrent activated condition of the three-phased coil portions 8, the magnetic flux is formed from the magnet 6 to each coil portion 8, whereby the magnet 6 fixed on the shaft 7 fails to be rotated. In addition, each coil portions 8 is supplied with a current, and the resultant heat quickly warms the cooling water in the chamber, thereby accelerating warming-up operation of the engine 3. It is to be noted the two adjacent coil portions 8 can be supplied with either currents of different direction or currents of same direction.

Instead of the foregoing method for preventing the rotation of the rotor 6, which is established in such a manner that all the coil portions 8 are supplied with current, flowing current through a specific one-phase coil portions 8, which are diagonally positioned, can be used, while maintaining the inactivated conditions of the other two-phase coil portions 8. The reason is that such an electric control of the coil portions 8 by the control division 14 holds the position of the rotor 6 unchanged, which causes the shaft 6 not to rotate. However, the heat generated at the activated coil portions 8 is one third of that generated by the foregoing method. Thus, if desired, more rapid warming-up of the engine 3 requires activating all of the three-phased coil portions 8.

The water pump 1 is brought into operation when the motor 2 is turned on concurrently with when the engine 3 is started, whereby the rotation of the rotor 6 causes rotation of the rotor or impeller 5, which circulates the cooling fluid through the radiator 12 and the engine 1. Normally, about four amperes (4 A) of current flows through each the coil portion 8. If the temperature sensor 21 indicates that the engine temperature is below a set value (e.g., 60 degrees centigrade), the control division 14 allows current to flow through all the coil portions 8 to stop rotation of the shaft 5. Under the resultant condition, while the current continues to flow through each coil portion 8, the rotor 6 is held against rotation and fails to generate a counter electromotive force in each coil portion 8. The current flowing through the coil portion 8 is then at its maximum, permissible current, which thereby rapidly heats the cooling water. The maximum working ampere of the motor 2 is set to be 50 A.

When heat is generated at each coil portion 8, the maximum current (50 A) flows therethrough and a heat amount of 600 W (12V×50 A) or 140 cal/sec is developed. Assuming that the chamber 11 is 70 cc in volume and the water is otherwise warmed by the engine 3, a temperature increase of at least 2 degrees per second is attained in the water in the chamber 11. If the temperature of the water rises above 60 degrees centigrade during such a warming of the circulating water in the chamber 11, the control division changes the activation mode to rotate the shaft 5 again, thereby re-starting the circulation of the cooling water through the radiator 12 and the engine 3. Whenever the water in the chamber 11 is cooler than 60 degrees centigrade, the control division stops rotating the rotor 6 in order to warm the water in the chamber before its circulation. The resultant or stopped condition of the rotor 6 is continued until the temperature sensor indicates that the water's temperature is above 60 degrees centigrade.

As explained above, flowing current continually in each coil portion 8 increases heat developed in each coil portion 8, thereby quickly warming up the cooling water. Thus, even though the engine 3 is started at a cold condition, the engine 3 can be rapidly warmed up.

As can be seen from FIG. 1, in addition to the water pump 1 driven by the electric motor 2, a second water pump 24 is provided to the engine 3 via a cam shaft 23 and, while the engine 3 is running and the temperature of the cooling water is below 60 degrees centigrade, the second pump 24 continues to operate to assist or prompt the circulation of the cooling water which is established by the water pump 1.

After the temperature of the cooling water rises above 60 degrees centigrade, at least a minimum or suitable flow rate of the cooling water is ensured by driving the water pump 1.

Due to the resultant cooling water, each coil portions 8, the rotor 6, the shaft 7 and other elements can be cooled down. In addition, setting the control division 14 to control the three-phase coil portions 8 based on the signal from the temperature sensor 21, which is indicative of the cooling water temperature and the engine rotational speed permits ensuring a minimum or suitable quantity of the cooling water by driving the water pump 1 only whenever it is requested to operate.

Figure 4:
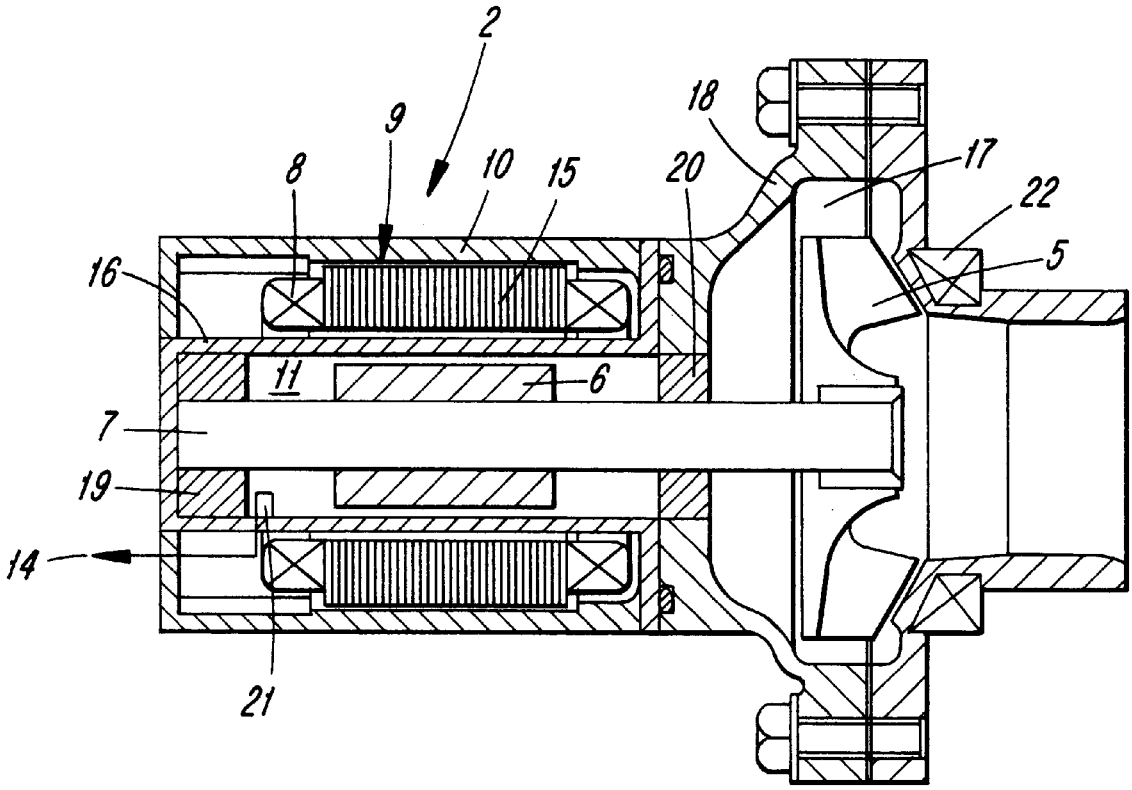
FIG. 4 is a cross-sectional view of another liquid pump as a modification of the liquid pump illustrated in FIG. 2.

Referring to FIG. 4, a modification of the water pump 1 of FIG. 2 is illustrated. This modified water pump 1 is designed to be stopped by an electromagnetic clutch 22. Employing such an electromagnetic clutch 22 as a rotation stopping means differentiates the modified embodiment of FIG. 4 from the original embodiment of FIG. 2. The clutch 22 is brought into its engaged condition upon activation thereof, and activating and deactivating control of the clutch 22 is performed by the control division 14. Elements other than the clutch 22 in FIGS. 4 and 5 are identical to those in FIGS. 1 through 3 and therefore are denoted by the same reference numerals.

The electromagnetic clutch 22 is secured to the housing in which the cooling water passage 17 is defined and is under control of the control division 14. In order prevent a re-rotation of the rotor or impeller 5 after an establishment of the engagement of the clutch 22, the electromagnetic force from the coil 22 is set so as to be larger than the starting torque of the electric motor 2, and while each of the coil portions 8 is being activated in turn, upon activation of the clutch 22 the metal-made impeller 5 is prevented from rotating.

Operation of the water pump 1 illustrated in FIG. 4 is similar to that of the water pump illustrated in FIG. 2, except for the method for stopping rotation of the impeller 5. More specifically, when the coil 22 is activated by the control division 14, the resultant electromagnetic force attracts the impeller 5, causing the impeller 5 to stop. Under the resultant condition, the rotor or magnet 22 is at rest, no counter electromotive force is generated in the motor 2, and as continual activation of each coil portion 8 is performed in turn, the maximum current continues to flow through each coil portion 8.

Figure 5:
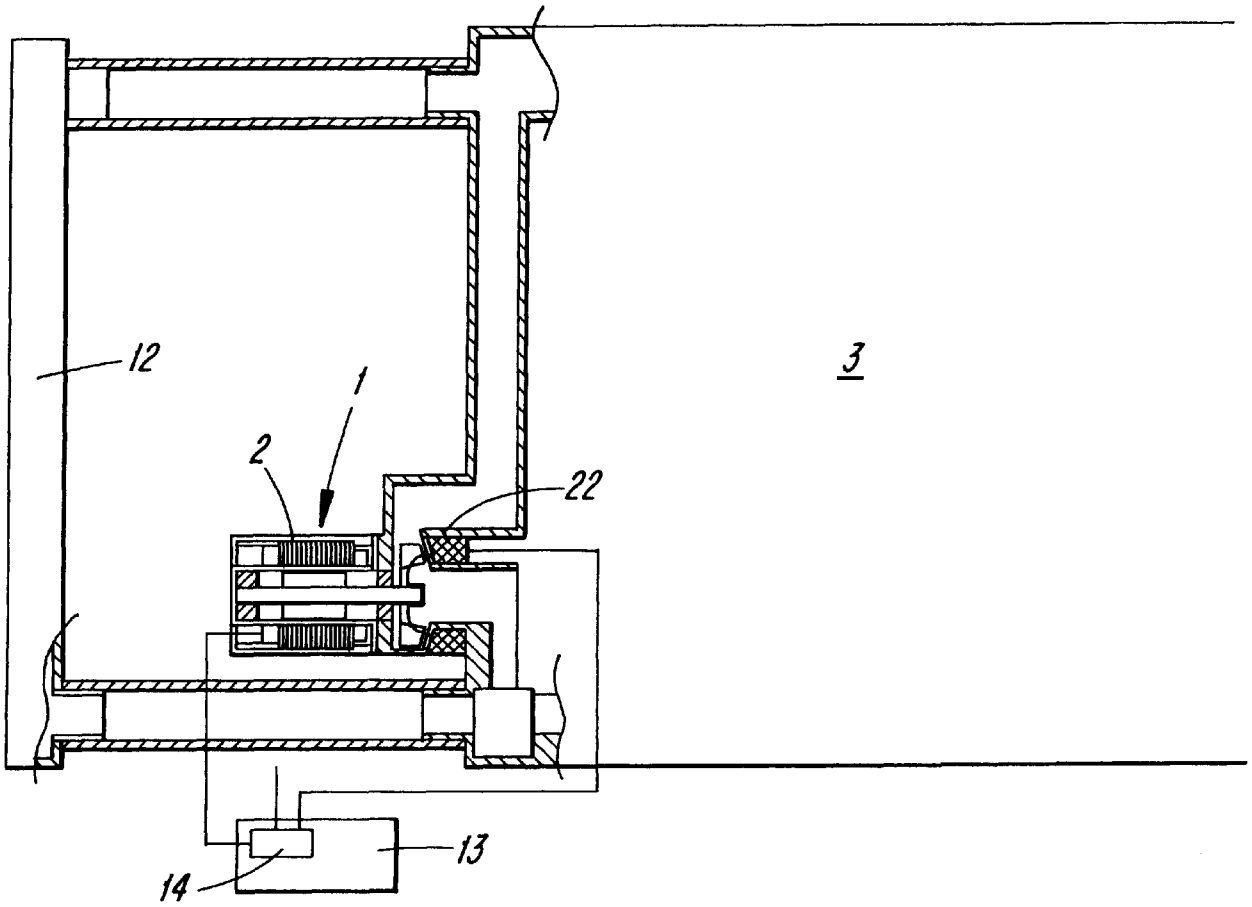
FIG. 5 is a schematic illustration of a second embodiment of a cooling device in accordance with the present invention.

As shown in FIG. 5, the second mode water pump 1 is fixed to a lower portion of the engine 3. Such an arrangement allows the cooling water heated by each coil portion 8 to circulate through the radiator 12 and the engine 3 by convection, which results in that no additional water pump is required. This leads to decreases in the number of parts and the manufacturing cost.

Figure 6:
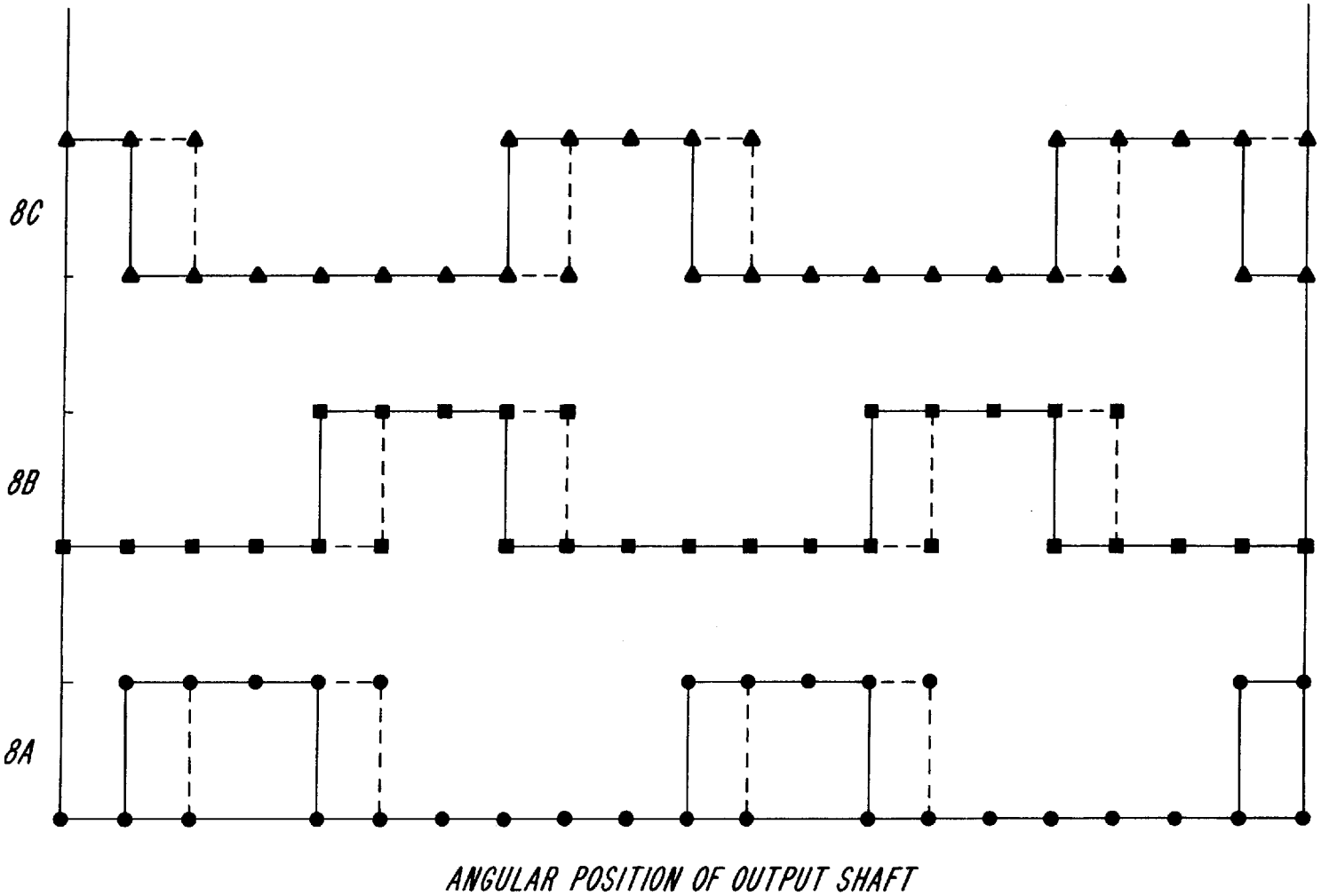
FIG. 6 is a chart showing a relationship between current supply to phase winding and an angular position of an output shaft of a motor.

In addition, it is to be noted that in brushless DC motors, if a current phase shift which is to be supplied to one of three phase windings is established relative to an angular position of an output shaft of a motor, this phase winding generates heat. In detail, referring to FIG. 6, as indicated by the solid lines, the phase windings 8A, 8B, and 8C are supplied with currents in such a manner that two adjacent current supplies are out of phase by 120 degrees. Each of such a current supply is used only to rotate the output shaft of the motor. However, as indicated in phantom line, if there is a phase shift of each of the current supplies with respect to an angular position of the output shaft of the motor, some of the current makes this phase winding generate heat, in a known manner. Such a phase-shifted current supply mode, unlike the foregoing current supply modes, fails to stop the rotation of the output shaft. Thus, heat can be transferred to the circulating cooling liquid when the temperature is below 60 degrees centigrade, thereby shorting time period for engine warming-up.

The invention has thus been shown and description with reference to specific embodiments, however, it should be understood that the invention is in no way limited to the details of the illustrates structures but changes and modifications may be made without departing from the scope of the appended claims.

What is claimed is:

1. A cooling device for an internal combustion engine comprising:

an electrically operated motor having phase windings, a housing, an output shaft, a magnet rotor fixedly mounted on the output shaft, and a stator positioned in the housing;

an impeller connected at an outside of the housing to one end of the output shaft of the motor for circulating a cooling liquid through the engine and a radiator while the output shaft is being rotated;

means for generating heat at the phase windings for warming-up the cooling liquid if a temperature thereof is below a set value; and wherein the cooling device is positioned at a lower side of the engine.

2. A cooling device in accordance with claim 1, wherein the heat generating means stops rotation of the output shaft of the motor without interrupting energization to the motor by controlling the energization to the motor.

3. A cooling device in accordance with claim 2, wherein the stator has three phase windings arranged circumferentially around the magnet rotor, the heat generating means supplying current concurrently to all of the phase windings.

4. A cooling device in accordance with claim 2, the heat generating means for supplying current to the phase windings in phase cycles of 120 degrees, and for supplying current with a phase difference relative to an angular position of the output shaft.

5. A cooling device in accordance with claim 2, wherein the impeller is made of a metal, the heat generating means comprises an electromagnetic clutch including the impeller and an electromagnetic coil provided to the housing so as to oppose rotation of the impeller.

6. A cooling device in accordance with claim 1, further comprising a chamber in the housing between the stator and the magnetic rotor for receiving cooling liquid therein.

7. A cooling device in accordance with claim 6, further comprising a temperature sensor installed in the chamber to determine the temperature of the cooling liquid.

8. A cooling device in accordance with claim 1, wherein the electrically operated motor is a brushless DC motor.

9. A cooling device for an internal combustion engine comprising:

an electrically operated motor having an output shaft and rotating the output shaft upon energization of the motor;

an impeller connected to one end of the output shaft for circulating a cooling liquid through the engine and a radiator while the output shaft of the motor is being rotated; and means for stopping the rotation of the output shaft of the motor without interrupting the energization of the motor when a temperature of the cooling liquid is below a set value.

10. A cooling device in accordance with claim 9, further comprising a housing, wherein the electric motor comprises a brushless DC motor and includes a magnet rotor fixedly mounted on the output shaft, a stator having three phase windings which are circumferentially arranged the output shaft, the magnetic rotor and the stator are positioned in the housing, the stopping means for continuing to energize at least one of the phase windings to stop the rotation of the output shaft when the temperature of the cooling liquid is below the set value.

11. A cooling device in accordance with claim 10, wherein the stopping means comprises a device which establishes concurrent energizing all of the phase windings.

12. A cooling device in accordance with claim 10, further comprising a housing, wherein the electric motor comprises a brushless DC motor and includes a magnetic rotor fixedly mounted on the output shaft, a stator having three phase windings which are circumferentially arranged around the output shaft, the magnetic rotor and the stator are positioned in the housing, the impeller is made of a metal, the stopping means comprises an electromagnetic clutch provided to the housing so as to be brought into electromagnetic coupling with the impeller despite energization of the motor when the temperature of the cooling liquid is below the set value.

13. A cooling device in accordance with claim 12, wherein the housing comprises a chamber for receiving cooling liquid under circulation, the chamber formed between the magnet rotor and the stator.

14. A cooling device in accordance with claim 10, wherein the housing comprises a chamber for receiving cooling liquid under circulation, the chamber formed between the magnet rotor and the stator.

15. A cooling device in accordance with claim 9, wherein the cooling device is positioned at a lower portion of the engine.

16. A cooling device for an internal combustion engine comprising:

a brushless DC motor having an output shaft, a magnetic rotor fixedly mounted on the output shaft, and a stator having three phase windings which are circumferentially arranged around the output shaft;

an impeller connected to one end of the output shaft for circulating a cooling liquid through the engine and a radiator while the output shaft of the motor is being rotated;

means for energizing the stator so that current supplied to each of the phase windings is supplied based on an angular position of the output shaft; and wherein the cooling device is positioned at a lower side of the engine.

* * * * *